United States Patent [19]

Pope et al.

[11] 4,219,616

[45] Aug. 26, 1980

[54] RECORDING MATERIALS FOR VESICULAR IMAGING

[75] Inventors: John A. Pope, Colchester; Stuart C. Rennison, Hadleigh; Ronald J. Stacey, Colchester, all of England

[73] Assignee: Imperial Chemical Industries Limited, London, England

[21] Appl. No.: 962,483

[22] Filed: Nov. 20, 1978

[30] Foreign Application Priority Data

Nov. 29, 1977 [GB] United Kingdom ..... 49609/77
Sep. 1, 1978 [GB] United Kingdom ..... 35306/78

[51] Int. Cl.[2] ..... G93C 1/58; G93C 1/52
[52] U.S. Cl. ..... 430/152; 430/290
[58] Field of Search ..... 96/49, 91 R

[56] References Cited

U.S. PATENT DOCUMENTS 3,779,774 12/1973 Cope et al. ..... 96/91 R
4,032,344 6/1977 Fletcher et al. ..... 96/49

OTHER PUBLICATIONS

Hawley, The Condensed Chemical Dictionary, Eight Edition p. 705.

*Primary Examiner*—Jack P. Brammer
*Attorney, Agent, or Firm*—Cushman, Darby & Cushman

[57] ABSTRACT

Vesicular recording materials incorporate a sensitized layer comprising, as vehicle for the sensitizing agent, a quaternized polyelectrolyte, e.g. preferably polymers of dimethylamino ethyl methacrylate. The water sensitivity of the preferred polymers is reduced by copolymerisation with insolubilizing comonomers such as itaconic acid.

12 Claims, No Drawings

RECORDING MATERIALS FOR VESICULAR IMAGING

The present invention relates to photographic recording materials which may be used for vesicular imaging.

Such materials are known in the art and generally comprise a transparent or opaque film or sheet support carrying an imaging layer comprising a vehicle, generally a thermoplastic material, and a sensitising agent dispersed throughout the vehicle. The sensitising agent is decomposable on exposure to a light image to evolve a gas such as nitrogen thereby forming a latent gas image in the vehicle. Generally, the latent image is developed by softening the vehicle by heating thereby enabling the latent gas image in the light-struck areas to expand into bubbles or vesicles which have a light-scattering or reflecting activity. A typical assembly is described in British patent specification No. 861,250.

The present invention relates to recording materials having improved plastics vehicles for the sensitising agent.

According to the present invention, a recording material suitable for vesicular imaging comprises a polymeric vehicle and dispersed uniformly therein a sensitising agent which releases a vesicle-forming gas upon exposure to light, said polymeric vehicle comprising a polyelectrolyte having a nitrogen permeability constant in the range $1\times10^{-17}$ to $1\times10^{-10}$ and being softenable upon heating to permit the gas released by the sensitising agent in the light-struck areas to form lightscattering or reflecting vesicles therein.

The term "nitrogen permeability constant" used herein refers to the volume of nitrogen in $cm^3$ transmitted at 30° C. by an area of one square cm of a sample of the polymeric vehicle in one second when the pressure gradient is one cm of mercury per one cm of transmission thickness.

The polymeric vehicle and sensitising agent are preferably applied as a recording layer to a carrier sheet or film. Opaque carriers may be used in recording materials when the image is to be viewed by reflection. In such an assembly, the image vesicles appear white upon reflection of incident light. The opaque carrier is preferably dark in colour to contrast with the image and may comprise a pigmented or coloured plastics film or sheet or paper or card. When the image is to be viewed by light-transmission through the recording material the carrier is preferably a transparent plastics sheet or film which may consist of any suitable plastics material such as cellulose esters, e.g. cellulose acetate, polystyrene, polyamides, polymers and copolymers of vinyl chloride, polycarbonate, polymers and copolymers of olefines, e.g. polypropylene, polysulphones and linear polyesters which may be obtained by condensing one or more dicarboxylic acids or their lower alkyl diesters, e.g. terephthalic acid, isophthalic, phthalic, 2,5-, 2,6- and 2,7-naphthalene dicarboxylic acid, succinic acid, sebacic acid adipic acid, azelaic acid, diphenyl dicarboxylic acid, and hexahydroterephthalic acid or bis-p-carboxyl phenoxy ethane, optionally with a monocarboxylic acid, such as pivalic acid, with one or more glycols, e.g. ethylene glycol, 1,3-propanediol, 1,4-butanediol, neopentyl glycol and 1,4-cyclohexanedimethanol. Biaxially oriented and heat-set films of polyethylene terephthalate are particularly useful as carriers according to this invention.

Polyelectrolytes suitable for use as the polymeric vehicle of the recording material may be anionic or cationic. Particularly suitable polymeric vehicles include cationic polyelectrolytes containing any of the following functional groups:

sulphonium:

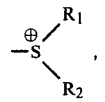

phosphonium:

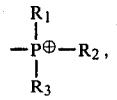

protonated primary, secondary and tertiary amines:

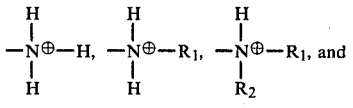

quarternary ammonium:

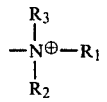

wherein $R_1$, $R_2$ and $R_3$ represent hydrogen or a lower alkyl group containing up to 6 carbon atoms. Where two or more of $R_1$, $R_2$ and $R_3$ are included in the same group, they may represent the same or different substituents.

Such functional groups may be introduced into the structure of the polymeric vehicle by protonating or quaternising appropriate monomers prior to polymerisation or by protonating or quaternising an already polymerised material.

The polyelectrolytes may be chosen from those described in the review by M. Fred Hoover entitled "Cationic Quaternary Polyelectrolytes—A Literarure Review" in J. Macromol Sci.-Chem., A4(6), pages 1327–1417, October 1970.

The preferred polyelectrolyte vehicles comprise quaternised homopolymers and copolymers of amino acrylates and methacrylates, such as dialkylamino alkyl acrylates, and methacrylates and most especially dimethylamino ethyl methacrylate.

Copolymers of such materials may be formed with one or more other ethylenically unsaturated comonomers which are copolymerisable therewith, such as styrene, α-methyl styrene, vinyl acetate, vinyl chloroacetate, acrylonitrile, methacrylonitrile, chloroacrylonitrile, acrylic acid, methacrylic acid and esters of acrylic acid and methacrylic acid. Comonomers comprising acrylic or methacrylic acids or their lower alkyl (up to 6 carbon atoms) esters are particularly effective, especially methyl methacrylate. Copolymers comprising 5 to 95 mole % of dimethylamino ethyl methacrylate produce suitable vehicles. A particularly preferred copolymer is the copolymer formed from equimolar quantities of dimethylamino ethyl methacrylate and methyl methacrylate.

Suitable quaternising materials for such amino acrylates and methacrylates include dialkyl sulphates, epihalohydrins, alkyl halides, alkyl toluene sulphonates, acrylamides, ethylene oxide, alkyl chloroacetates and haloacetamides, e.g. chloroacetamide.

Quaternisation can also be achieved by direct protonation with mineral or organic acids such as hydrochloric acid or sulphuric acid, or acetic acid or p-toluene sulphonic acid.

The sensitising agent incorporated into the vehicle should be non-reactive with the vehicle. Likewise the vesicle-forming gas which is liberated by the sensitising agent should be non-reactive with the vehicle. Sensitising agents which liberate nitrogen on exposure to actinic light, especially ultra-violet light which is widely used in vesicular processing equipment, may be employed according to this invention, suitable agents including nitrogen liberating diazonium salts, such as those which may be derived from the following amines:

N,N-dimethyl-p-phenylenediamine
N,N-diethyl-p-phenylenediamine
N,N-dipropyl-p-phenylenediamine
N-ethyl-N-$\beta$-hydroxyethyl-p-phenylenediamine
N,N-dibenzyl-3-ethoxy-4p-phenylenediamine
4-N-morpholino-aniline
2,5-diethoxy-4-N-morpholino-aniline
2,5-dimethoxy-4-N-morpholino-aniline
2,5-di-(n-butoxy)-4-N-morpholino-aniline
4-N-pyrrolidino-aniline
3-methyl-4-N-pyrrolidino-aniline
3-methoxy-4-N-pyrrolidino-aniline
2-ethoxy-4-N,N-diethylamino-aniline
2,5-diethoxy-4-benzoylamino-aniline
2,5-diethoxy-4-thio(4'-tolyl)-aniline If desired, a small quantity of a dyestuff may be included in the recording layer.

The recording layer may be applied to the carrier as a solution in water or a common organic solvent, such as butan-2-one, propanone, or methanol used alone or as a mixture of two or more solvents, by any suitable known coating technique.

If desired, the surface of the carrier may be pretreated and/or coated with an adhesion-promoting layer prior to the application of the recording layer. The adhesion of the recording layer to a plastics sheet or film carrier may in particular be improved by such a treatment. Polyethylene terephthalate film carriers may be pretreated by coating with solutions of materials having a solvent or swelling action on the film such as halogenated phenols in common organic solvents, e.g. solutions of p-chloro-m-cresol, 2:4-dichlorophenol, 2:4:6-or 2:4:5-trichlorophenol or 4-chloro-resorcinol or a mixture of such materials in acetone or methanol. After application of such a solution the film surface can be dried and heated at an elevated temperature for a few minutes, e.g. 2 minutes at 60° to 80° C. If desired, the pretreating solution may also contain an adhesion-promoting polymer, such as a partially hydrolysed copolymer of vinyl chloride and vinyl acetate.

As an alternative to, or in addition to, such a pretreatment, a material having a swelling or solvent action upon the film may be incorporated into the coating composition from which the recording layer is applied.

The resulting recording materials may be exposed to a light image in a conventional manner to produce a latent image in the recording layer. The image may be developed in a conventional manner by heating immediately after light exposure to permit the gas vesicles to form in the light-struck areas. Fixing may then be accomplished by a further overall light exposure and permitting the gas evolved by the decomposition of the sensitising agent to diffuse out of the recording layer. Alternatively, the latent image may be reversal processed by permitting the gas evolved in the imagewise light-struck areas to diffuse out of the recording layer and then subjecting the material to an overall light exposure followed by immediate heating to form gas vesicles in the areas subjected to the overall exposure.

The recording materials produced from the polymeric vehicles specified above provide vesicular images having a good maximum density and a wide tonal range. Some known prior art polymeric vehicles only produce images of wide tonal range if the material is treated with an aqueous solution or steam or water vapour prior to imagewise light exposure and development, e.g. as described in U.S. Pat. No. 3,149,971. It has been found surprisingly that the recording materials of the present invention provide a satisfactory range of image tones without such a treatment.

Some polymeric vehicles employed in the recording materials according to this invention may exhibit a tendency to dissolve in aqueous media thereby leading to difficulties in handling, e.g. marking of the polymeric vehicle by fingerprints, and a risk of the imaging vesicles collapsing on account of water absorption by the polymeric vehicle. It is therefore preferred to modify the polymeric vehicle or to overcoat the recording layer with a water impermeable water, e.g. an impermeable layer of a copolymer of vinylidene chloride or a copolymer of methyl methacrylate, in order to improve the durability of the material. The polymeric vehicle may be modified by the inclusion of an insolubilising anion in the polyelectrolyte, by cross-linking the polymer, or by admixing the polymer with insoluble or less soluble polymers.

The water solubility of polyelectrolytes comprising copolymers of amino acrylates, such as dialkylamino alkyl acrylates, as described above, may be minimised or eliminated by preparing the copolymer from a comonomeric mixture including an insolubilising comonomer in addition to or in place of the comonomers, other than the amino acrylate, listed above. Suitable insolubilising comonomers are chosen to introduce an insolubilising anion into the copolymeric structure of the polyelectrolyte. An especially suitable insolubilising comonomer is itaconic acid which is preferably employed in an amount in the range 1 to 25 mole % based upon the total molar content of the comonomeric mixture. Itaconic acid is effective as an insolubilising comonomer without the need for cross-linking of the copolymer by such means as the addition of cross-linking agents. Copolymers derived from higher amounts of itaconic acid, when applied to a carrier sheet or film by solvent coating as described above, are difficult to dry by conventional drying operations without discolouration of the polymer as a result of reaction between the sensitising diazonium salt and the copolymer. The use of drying conditions which avoid discolouration generally results in some solvent being retained in the recording layer. The retained solvent does not in any way impair the vesiculating mechanism although it does introduce a tendency for the formation of large vesicles which may in some end uses, such as microfilm, lead to poor image resolution. Copolymers derived from smaller amounts of itaconic acid are less prone to solvent retention and hence exhibit better image resolution. Accordingly, it is preferred to use amounts of itaconic acid not exceeding 15 mole %, and where good image resolution is important, not exceeding 12 mole %. Polymeric vehicles having reduced water solubility and reduced sensitivity to the absorption of water vapour may be prepared by copolymerising comonomeric mixtures of 42.5 mole % dimethylamino ethyl methacrylate, 42.5 mole % methyl methacrylate and 15 mole % itaconic acid or, for better image resolution, 45 mole % dimethylamino ethyl methacrylate, 45 mole % methyl methacrylate and 10 mole % itaconic acid.

The invention is further illustrated by the following Examples. The terms employed in the Examples and the methods of determining the respective properties are as follows:

"$D_{max}$" (maximum projection density) relates to the densest image which can be produced in a processed material, the values quoted in the Examples being measured by a Macbeth Quantalog Densitometer Model TD 528 at an aperture of f4.5 using a Wratten 106 filter.

"$D_{min}$" relates to the lowest density which can be obtained in a processed material, the values quoted in the Examples being measured by a Macbeth Quantalog Densitometer Model TD 528 at an aperture of f4.5 using a Wratten 106 filter.

"Gamma" represents the rate of change of image density with respect to changes in the logarithm (base 10) of the exposure and is derived from the characteristic curve, i.e. the curve of density/$\log_{10}$ exposure, of the material, as the slope of the straight-line portion of the curve. For low gamma a small change in exposure produces a small change in density whilst for high gamma the same small change in exposure produces a larger change in density.

"Tonal range" relates to the relative ability of the material to reproduce accurately the varying tones in an object, the values quoted in the Examples being assessed as the number of visible image steps upon the material after exposure through a Kodak Photographic Step Wedge No. 2 and development. The first step of the wedge is transparent and each subsequent step increasingly opaque. The ability of the material to reproduce images of the successive steps is a measure of its tonal range.

"Resolution" relates to the ability of materials to record visible fine detail of an object and is a measure of the sharpness of the image produced. The values quoted hereinafter were measured using a Microform Reader Resolution Test Chart produced by NCR Ltd and using the method described in International Standard ISO 3334.

EXAMPLE 1

The polymeric vehicle used in this Example was a copolymer of equimolar amounts of dimethylamino ethyl methacrylate and methyl methacrylate (DMAEMA/MMA, 50:50 in the following Table) which had been quaternised with chloroacetamide and having a nitrogen permeability constant of $7\times10^{-15}$. A coating solution of the following composition was prepared:

Polymeric vehicle—10.0 g
2,5-diethoxy-4-morpholino-benzene diazonium fluoroborate—0.7 g
Propanone—20.0 g
Methanol—20.0 g One surface of a 100 micron thick biaxially oriented and heat-set transparent film of polyethylene terephthalate was pretreated with a solution of 2 g of p-chloro-m-cresol in 100 ml of methanol and then uniformly coated with the above coating solution. After drying at 100° C. for 5 minutes, the deposited coating provided a recording layer of thickness 6 microns.

The resulting recording material was exposed for 10 seconds to ultra-violet light through a Kodak Photographic Step Wedge No. 2 in a commercially available vesicular film printer (Canon Kal-Printer 480VC). The exposed film was immediately developed by heating at a temperature of 125° C. for 2 seconds in a commercially available developer (Canon Kal-Developer). Finally, the film was fixed by an overall exposure to ultraviolet light for 15 seconds and allowing the nitrogen evolved by the diazonium salt to diffuse out of the recording layer.

The projection density of the material was measured on a Macbeth Quantalog Densitometer Model TD 528.

An excellent vesicular copy of the step wedge having a high maximum density and wide tonal range was obtained without any post-treatment of the unexposed film. The photographic characteristics of the film were as follows:

| tonal range - visible steps | $D_{max}$ | $D_{min}$ | Gamma |
|---|---|---|---|
| 6 | 2.30 | 0.11 | 5.0 |

EXAMPLE 2

The polymeric vehicle used in this Example was a homopolymer of dimethylamino ethyl methacrylate which had been protonated with hydrochloric acid.

A coating solution of the following composition was prepared:

Polymeric vehicle—10.0 g
2,5-diethoxy-4-morpholino-benzene diazonium fluoroborate—0.7 g
Methanol—40.0 g The coating solution was applied to the pretreated surface of a polyethylene terephthalate film exposed through a Kodak Photographic Step Wedge No. 2, developed by heating and fixed by a further overall exposure in accordance with the procedure described in Example 1, with the exception that the exposure through the step wedge was of 22 seconds duration.

The resulting vesicular copy had a high maximum density and wide tonal range without the need for any post-treatment of the unexposed film. The photographic characteristics were as follows:

| Tonal range - visible steps | $D_{max}$ | $D_{min}$ | Gamma |
|---|---|---|---|
| 6 | 1.92 | 0.17 | 4.5 |

EXAMPLE 3

The polymeric vehicle used in this Example was a copolymer of dimethylamino ethyl methacrylate, methyl methacrylate and itaconic acid in the respective molar proportions 45:45:10 (DMAEMA/MMA/IA, 45:45:10 in the following Table), which had been quaternised with chloroacetamide.

A coating solution of the following composition was prepared:

Polymeric vehicle—10.0 g
2,5-diethoxy-4-morpholino-benzene diazonium fluoroborate—0.8 g
Maleic acid—1.0 g
Propanone—12.0 g
Methanol—12.0 g The coating solution was applied to the surface of a polyethylene terephthalate film which had been pretreated as described in Example 1 and after seasoning for 2 minutes at 120° C. the deposited coating provided a layer of thickness 6 microns.

The resulting recording material was exposed, developed and fixed in accordance with the procedure described in Example 1 with the exception that the exposure time was 15 seconds duration.

The resulting vesicular copy had a high maximum density and wide tonal range without the need for any post-treatment of the unexposed film. The photographic characteristics were as follows:

| Tonal range - visible steps | $D_{max}$ | $D_{min}$ | Gamma | Resolution |
|---|---|---|---|---|
| 6 | 2.61 | 0.14 | 12.6 | 140 line pairs per mm |

EXAMPLE 4

The polymeric vehicle used in this Example was a copolymer of dimethylamino ethyl methacrylate, methyl methacrylate and itaconic acid in the respective molar proportions 42.5:42.5:15 (DMAEMA/MMA/IA, 42.5:42.5:15 in the following Table), which had been quaternised with chloroacetamide.

A coating solution of the following composition was prepared:

Polymeric vehicle—10.0 g
2,5-diethoxy-4-morpholino-benzene diazonium fluoroborate—0.8 g
Maleic acid—1.0 g
Propanone—9.0 g
Methanol—14.0 g The coating solution was applied to the surface of a polyethylene terephthalate film which had been pretreated as described in Example 1 and after seasoning for 5 seconds at 120° C. the deposited coating provided a layer of thickness 6 microns.

The resulting recording material was exposed, developed and fixed in accordance with the procedure described in Example 1 with the exception that the exposure time was 15 seconds duration.

The resulting vesicular copy had a high maximum density without the need for any post-treatment of the unexposed film. The photographic characteristics were as follows:

| Tonal range - visible steps | $D_{max}$ | $D_{min}$ | Gamma | Resolution |
|---|---|---|---|---|
| 4 | 2.00 | 0.20 | 6.4 | 30 line pairs per mm |

The vesicular copies produced in Examples 1, 3 and 4 were placed in humidity cabinets at controlled temperatures and relative humidities for specific times. The loss of maximum projection density for each sample was determined as a percentage of the original maximum density, with the results shown in the following Table. The developed vesicular images of Examples 3 and 4 had superior water-vapour stability to the image of Example 1.

TABLE

| | | Percentage loss of maximum projection density | | |
|---|---|---|---|---|
| | | at 21° C. and 65% relative humidity after: | | at 50° C. and 80% relative humidity after: |
| Example | Copolymeric vehicle | 3 hours | 24 hours | 3 hours |
| 1 | DMAEMA/MMA 50:50 | 19% | 93% | 95% |
| 3 | DMAEMA/MMA/IA 45:45:10 | 0% | 1% | 81% |
| 4 | DMAEMA/MMA/IA 42.5:42.5:15 | 0% | 0% | 19% |

We claim:

1. A recording material suitable for vesicular imaging, which consists essentially of a polymeric vehicle and dispersed uniformly therein a sensitising agent which releases a vesicle-forming gas upon exposure to light so as to provide a latent gas image in the polymeric vehicle, said polymeric vehicle consisting of a polyelectrolyte having a nitrogen permeability constant in the range $1\times10^{-17}$ to $1\times10^{-10}$ and being softenable upon heating to permit the gas released by the sensitising agent in the light-struck areas to form light-scattering or reflecting vesicles therein.

2. A recording material according to claim 1, in which the polymeric vehicle is a cationic polyelectrolyte containing a sulphonium, phosphonium, quaternary ammonium or protonated primary, secondary or tertiary amine group as hereinbefore defined.

3. A recording material suitable for vesicular imaging, which consists essentially of a polymeric vehicle and dispersed uniformly therein a sensitising agent which releases a vesicle-forming gas upon exposure to light, said polymeric vehicle consisting essentially of a quaternised homopolymer or copolymer of an amino acrylate having a nitrogen permeability constant in the range $1\times10^{-17}$ to $1\times10^{-10}$ and being softenable upon heating to permit the gas released by the sensitising agent in the light-struck areas to form light-scattering or reflecting vesicles therein.

4. A recording material according to claim 3, in which the polymeric vehicle comprises a copolymer of 5 to 95 mole % of dimethylamino ethyl methacrylate.

5. A recording material according to claim 4, in which the polymeric vehicle comprises a copolymer of equimolar quantities of dimethylamino ethyl methacrylate and methyl methacrylate.

6. A recording material according to claim 3, in which the layer comprising the polymeric vehicle and the sensitising agent is overcoated with a water-impermeable layer.

7. A recording material according to claim 3, in which the polymeric vehicle is modified by the inclusion of an insolubilising anion in the polyelectrolyte, by cross-linking the polymer, or by admixing the polymer with a polymer insoluble or less soluble in water.

8. A recording material according to claim 3, in which the polyelectrolyte vehicle is derived from a copolymer of an amino acrylate and 1 to 25% mole % of itaconic acid based upon the total molar content of the comonomeric mixture.

9. A recording material according to claim 8, in which the proportion of itaconic acid in the copolymer does not exceed 15 mole %.

10. A recording material according to claim 9, in which the polyelectrolyte comprises a comonomer of 42.5 mole % dimethylamino ethyl methacrylate/42.5 mole % methyl methacrylate/15 mole % itaconic acid or a copolymer of 45 mole % dimethylamino ethyl methacrylate/45 mole % methyl methacrylate/10 mole % itaconic acid.

11. A recording material according to claim 8, in which the polymeric vehicle is a quaternised copolymer of an amino acrylate.

12. A recording material according to claim 8, in which the polymeric vehicle comprises a copolymer of 5 to 95 mole % of dimethylamino ethyl methacrylate.

* * * * *